US008256230B2

(12) United States Patent
An et al.

(10) Patent No.: US 8,256,230 B2
(45) Date of Patent: Sep. 4, 2012

(54) OPERATING SYSTEM OF LIQUEFIED NATURAL GAS SHIP FOR SUBCOOLING AND LIQUEFYING BOIL-OFF GAS

(76) Inventors: Hyung-Su An, Geoje-si (KR); Nam-Su Kim, Suwon-si (KR); Jin-Yeol Yun, Geoje-si (KR); Hyun-Jin Kim, Gwangju-si (KR); Hyun-Ki Park, Geoje-si (KR)

( * ) Notice: Subject to any disclaimer, the term of this patent is extended or adjusted under 35 U.S.C. 154(b) by 232 days.

(21) Appl. No.: 12/688,411

(22) Filed: Jan. 15, 2010

(65) Prior Publication Data

US 2010/0139316 A1 Jun. 10, 2010

Related U.S. Application Data

(62) Division of application No. 12/001,146, filed on Dec. 10, 2007, now abandoned, and a division of application No. 11/184,282, filed on Jul. 19, 2005, now abandoned.

(30) Foreign Application Priority Data

Jan. 18, 2005 (KR) ..... 10-2005-0004649
Jan. 18, 2005 (KR) ..... 10-2005-0004650

(51) Int. Cl.
*F17C 3/10* (2006.01)

(52) U.S. Cl. ..... 62/48.2

(58) Field of Classification Search ..... 62/48.2, 62/53.2, 611–614, 48.1
See application file for complete search history.

(56) References Cited

U.S. PATENT DOCUMENTS

| | | | | |
|---|---|---|---|---|
| 3,885,394 | A | 5/1975 | Witt et al. | |
| 4,249,387 | A * | 2/1981 | Crowley | 62/48.2 |
| 4,483,376 | A | 11/1984 | Bresie et al. | |
| 6,530,241 | B2 | 3/2003 | Pozivil | |
| 6,901,762 | B2 | 6/2005 | Irie et al. | |
| 7,299,655 | B2 | 11/2007 | Ward | |
| 2001/0042377 | A1 | 11/2001 | Pozivil | |

FOREIGN PATENT DOCUMENTS

WO WO 2005047761 A1 * 5/2005

* cited by examiner

*Primary Examiner* — John Pettitt
(74) *Attorney, Agent, or Firm* — Hoffmann & Baron, LLP

(57) ABSTRACT

A method for reliquefying boil-off gas generated in a cargo tank of a liquefied natural gas ship generally includes the steps of compressing boil-off gas generated in the cargo tank with a compressor, sub-cooling the compressed boil-off gas in a heat exchanger, feeding the liquefied gas to a gas phase separator, venting flash gas generated in the gas phase separator through a first pipe, feeding the vented flash gas from the gas phase separator to a gas combustion unit of the ship via the first pipe, oxidizing the vented flash gas in the gas combustion unit, diverting a portion of the compressed boil-off gas from the compressor through a second pipe, feeding the diverted portion of compressed boil-off gas from the compressor to an upper region of the gas-phase separator and returning liquefied gas from the gas-phase separator to the cargo tank.

2 Claims, 3 Drawing Sheets

FIG.. 3

| item | conventional art | present invention |
|---|---|---|
| LNG phase separator operating condition | saturated liquefaction<br>▪ temperature:-157.7℃<br>▪ pressure:3.0 bar,g | sub-cooled liquefaction<br>▪ temperature:-161.7℃<br>▪ pressure:3.0 bar,g |
| boil-off gas compressor operating condition | ▪ Capacity:6505 kg/hr<br>▪ power consumption:314KW | ▪ Capacity:6127 kg/hr<br>▪ power consumption:300KW |
| total power consumption | 5265 KW(100%) | 5166 KW(98.1%) |
| cold duty of cryogenic heat exchanger | 7067 KW(100%) | 6945 KW(98.3%) |

OPERATING SYSTEM OF LIQUEFIED NATURAL GAS SHIP FOR SUBCOOLING AND LIQUEFYING BOIL-OFF GAS

CROSS-REFERENCE TO RELATED APPLICATIONS

This application is a divisional application of U.S. application Ser. No. 12/001,146, filed on Dec. 10, 2007, which is a divisional application of U.S. application Ser. No. 11/184,282, filed Jul. 17, 2005, which claims priority to Korean application Nos. 10-2005-0004649 and 10-2005-004650, both filed on Jan. 18, 2005. U.S. application Ser. Nos. 12/001,146 and 11/184,282 are incorporated herein by reference in their entirety, for all purposes.

BACKGROUND OF THE INVENTION

1. Field of the Invention

The present invention relates to an operating system of a liquefied natural gas ship for sub-cooling and liquefying boil-off gas, and more particularly, to an operating system of a liquefied natural gas ship for sub-cooling and liquefying boil-off gas in which a re-liquefaction system of boil-off gas in a liquefied natural gas ship is modified into an efficient sub-cooling and liquefaction structure so that power consumption is reduced, operation is simply performed, and economic efficiency can be achieved.

2. Description of the Related Art

Generally, boil-off gas generated from a cargo tank is re-liquefied into liquefied natural gas using a re-liquefaction system installed in a compressor and motor room of a liquefied natural gas ship, and the re-liquefied boil-off gas is returned back to the cargo tank.

There are several basic operating systems in the re-liquefaction system, such as partial liquefaction, saturated liquefaction, sub-cooled liquefaction, and the like. The sub-cooled liquefaction is superior to the others in view of power consumption, simple operation, etc., and the present invention provides an operating system for sub-cooled liquefaction of boil-off gas adapted to have a more efficient structure.

SUMMARY OF THE INVENTION

Therefore, the present invention has been made in view of the above and/or other problems, and it is an object of the present invention to provide an operating system of a liquefied natural gas ship for sub-cooling and liquefying boil-off gas in which a re-liquefaction system of boil-off gas in a liquefied natural gas ship is modified into an efficient sub-cooling and liquefaction structure so that power consumption is reduced, operation is simply performed, and economical efficiency can be achieved.

In accordance with the present invention, the above and other objects can be accomplished by the provision of an operating system of a liquefied natural gas ship for performing sub-cooled liquefaction of boil-off gas for re-liquefaction including a boil-off gas compressor, a cryogenic heat exchanger connected to a refrigerator system, and a first check valve and a first pressure control valve, installed in a pipe connecting a liquefied natural gas phase separator with a gas combustion unit, the operating system further including: a parallel pipe connected to the pipe for connecting the liquefied natural gas phase separator with the first check valve in parallel and having the same structure as that of the pipe in which the first check valve and the first pressure control valve are installed; a second check valve installed in the parallel pipe and preventing reverse flow of gas generated when pressure of the pipe is abnormally increased; and a second pressure control valve installed in the parallel pipe and maintaining a predetermined pressure of the liquefied natural gas phase separator by adjusting a quantity of boil-off gas generated by the boil-off gas compressor such that the liquefied natural gas phase separator, operated under the sub-cooling condition, is stably operated; wherein an end of the parallel pipe is connected to a pipe between the boil-off gas compressor and the cryogenic heat exchanger such that boil-off gas, discharged from the boil-off gas compressor, is supplied to an upper vapor region of the liquefied natural gas phase separator for the purpose of blanket during sub-cooling liquefying operation, so that pressure and level of liquefied natural gas of the liquefied natural gas phase separator are stably controlled.

In accordance with the present invention, the above and other objects can be accomplished by the provision of an operating system of a liquefied natural gas ship for performing sub-cooled liquefaction of boil-off gas for re-liquefaction including a boil-off gas compressor, a cryogenic heat exchanger connected to a refrigerator system, and a first check valve and a first pressure control valve, installed in a pipe connecting a liquefied natural gas phase separator with a gas combustion unit, the operating system further including: a parallel pipe connected to the pipe for connecting the liquefied natural gas phase separator with the first check valve in parallel and having the same structure as that of the pipe in which the first check valve and the first pressure control valve are installed; a nitrogen generator connected to the parallel pipe and installed in a machinery space of the liquefied natural gas ship and to supply nitrogen gas to the liquefied natural gas phase separator, operated under the sub-cooling condition, for the purpose of maintaining a predetermined pressure of the liquefied natural gas phase separator; a second check valve for preventing reverse flow generated when pressure of the pipe is abnormally increased; and a second pressure control valve for maintaining a predetermined pressure of the liquefied natural gas phase separator by adjusting a quantity of nitrogen gas for the purpose of stable operation of the liquefied natural gas phase separator operated under the sub-cooling condition; wherein nitrogen gas is supplied from the nitrogen generator to a vapor region of the liquefied natural gas phase separator for the purpose of blanket during the sub-cooled liquefaction, so that pressure and level of liquefied natural gas of the liquefied natural gas phase separator are stably controlled.

BRIEF DESCRIPTION OF THE DRAWINGS

The object and advantages of the present invention will become apparent and more readily appreciated from the following description of an embodiment, taken in conjunction with the accompanying drawings, in which:

FIG. 3 is a table comparing operation according to the operating system for performing sub-cooled liquefaction of boil-off gas in a liquefied natural gas ship of the present invention with operation according to a conventional operation system for performing saturated liquefaction of boil-off gas in a liquefied natural gas ship.

DESCRIPTION OF THE PREFERRED EMBODIMENTS

Figure 1:
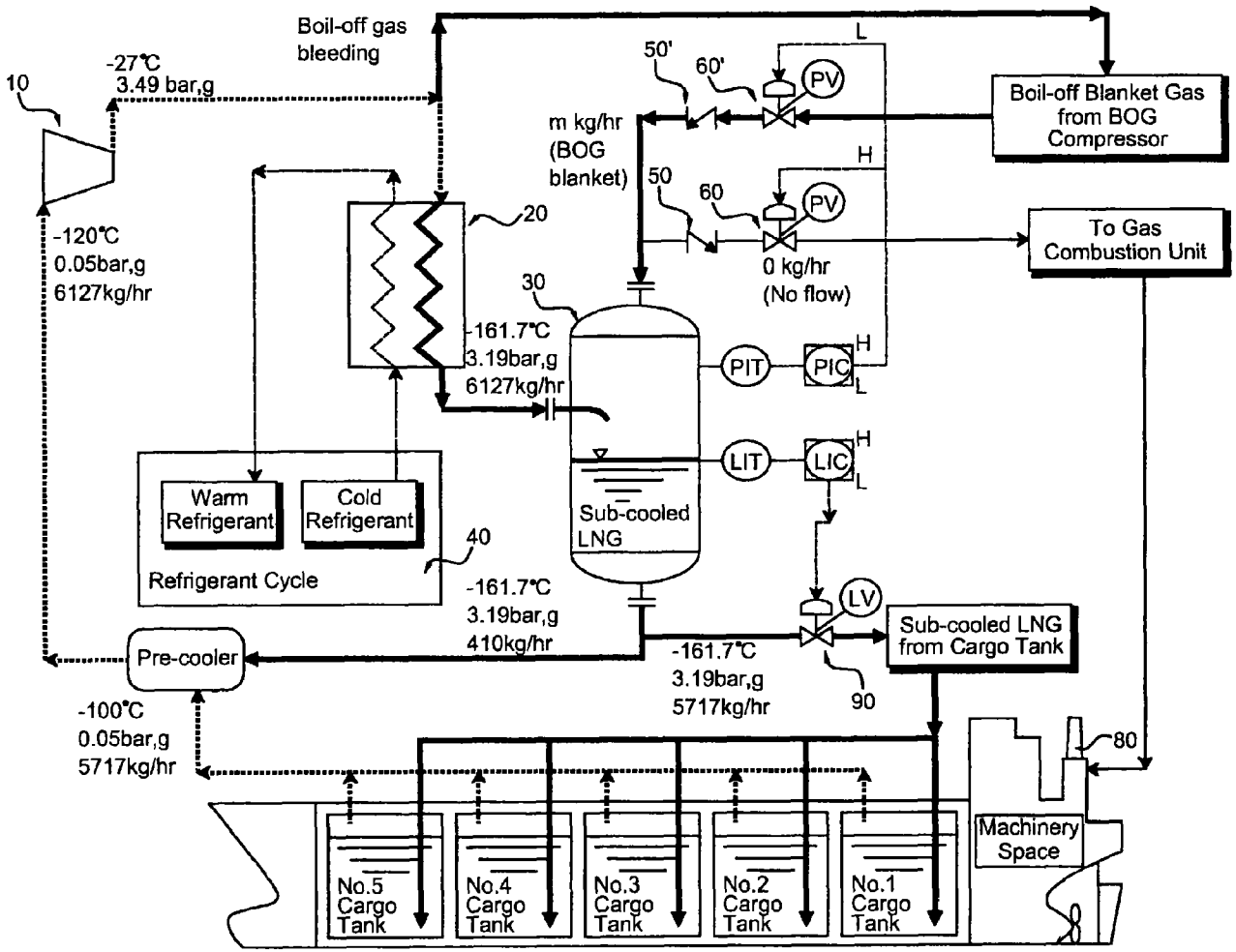
FIG. 1 is a schematic system diagram illustrating an operating system for performing sub-cooled liquefaction of boil-off gas in a liquefied natural gas ship according to a preferred embodiment of the present invention.

An operating system of a liquefied natural gas ship for performing sub-cooled liquefaction of boil-off gas for re-liquefaction according to a first preferred embodiment of the present invention includes a boil-off gas compressor 10, a cryogenic heat exchanger 20 connected to a refrigerator system 40 and a check valve 50, and a pressure control valve 60, installed in a pipe connecting a liquefied natural gas phase separator 30 with a gas combustion unit 80. The operating system of a liquefied natural gas ship further includes a parallel pipe connected to a pipe for connecting the liquefied natural gas phase separator 30 with the check valve 50 in parallel and has the same structure as that of the pipe in which the check valve 50 and the pressure control valve 60 are installed. The parallel pipe includes a check valve 50' for preventing reverse flow of gas generated when pressure of the pipe is abnormally increased, and a pressure control valve 60' for maintaining a predetermined pressure of the liquefied natural gas phase separator 30 by adjusting the quantity of boil-off gas generated by the boil-off gas compressor 10 such that the liquefied natural gas phase separator 30, operated under the sub-cooling condition, is stably operated. An end of the parallel pipe is connected to a pipe between the boil-off gas compressor 10 and the cryogenic heat exchanger 20 such that boil-off gas, discharged from the boil-off gas compressor 10, is supplied to an upper vapor region of the liquefied natural gas phase separator 30 for the purpose of blanket during sub-cooling liquefying operation, so that pressure and level of liquefied natural gas of the liquefied natural gas phase separator 30 are stably controlled.

Moreover, an operating system of a liquefied natural gas ship for performing sub-cooled liquefaction of boil-off gas for re-liquefaction according to a second preferred embodiment of the present invention includes a boil-off gas compressor 10, a cryogenic heat exchanger 20 connected to a refrigerator system 40, and a check valve 50 and a pressure control valve 60, installed in a pipe connecting a liquefied natural gas phase separator 30 with a gas combustion unit 80. The operating system of a liquefied natural gas ship further includes a parallel pipe connected to a pipe for connecting the liquefied natural gas phase separator 30 with the check valve 50 in parallel and has the same structure as that of the pipe in which the check valve 50 and the pressure control valve 60 are installed. The parallel pipe is connected to a nitrogen generator 70 installed in a machinery space of the liquefied natural gas ship and serves to supply nitrogen gas to the liquefied natural gas phase separator 30, operated under the sub-cooling condition, for the purpose of maintaining a predetermined pressure of the liquefied natural gas phase separator 30, and includes a check valve 50' for preventing reverse flow generated when pressure of the pipe is abnormally increased and a pressure control valve 60' for maintaining a predetermined pressure of the liquefied natural gas phase separator 30 by adjusting the quantity of nitrogen gas for the purpose of stable operation of the liquefied natural gas phase separator 30 operated under the sub-cooling condition. Thus, nitrogen gas is supplied from the nitrogen generator 70 to a vapor region of the liquefied natural gas phase separator 30 for the purpose of blanket during the sub-cooled liquefaction, so that pressure and level of liquefied natural gas of the liquefied natural gas phase separator 30 are stably controlled.

Elements of the operating system of a liquefied natural gas ship for performing sub-cooled liquefaction of boil-off gas for re-liquefaction according to the first preferred embodiment of the present invention will be described in detail with reference to FIG. 1 as follows.

The boil-off gas compressor 10 compresses boil-off gas generated by a cargo tank of the liquefied natural gas ship at a predetermined pressure and supplies the same to the cryogenic heat exchanger 20 for the purpose of stable re-liquefaction of boil-off gas.

The cryogenic heat exchanger 20 performs heat exchange between the boil-off gas compressed at the predetermined pressure and cold refrigerant introduced from the refrigerator system 40 to liquefy the compressed boil-off gas.

The liquefied natural gas phase separator 30 connected to the cryogenic heat exchanger 20 serves as a buffer tank for stably returning liquefied natural gas liquefied by the cryogenic heat exchanger 20 to the cargo tank. Meanwhile, since a predetermined pressure and a predetermined level of liquefied natural gas are maintained, a level control valve 90 for maintaining a predetermined level of liquefied natural gas is connected to the liquefied natural gas phase separator 30.

In order to sub-cool boil-off gas, a specific quantity of refrigerant having a specific temperature is required. A refrigerator system 40, serving as a refrigerator system for producing the required refrigerant, includes compressors, coolers, and a turbo-expander and is connected to the cryogenic heat exchanger 20.

The liquefied natural gas phase separator 30 is connected to the check valve 50 for preventing reverse flow generated when pressure of the gas combustion unit 80 is abnormally increased, and the pressure control valve 60 for maintaining a predetermined pressure of the liquefied natural gas phase separator 30 by discharging flash gas generated by the liquefied natural gas phase separator 30 when flash gas is generated and pressure is increased due to the abnormal operation of the liquefied natural gas phase generator 30.

The gas combustion unit 80 oxidizes the flash gas generated by the liquefied natural gas phase separator 30 when flash gas is generated and pressure thereof is increased due to the abnormal operation of the liquefied natural gas phase separator 30 so as to maintain the predetermined pressure of the liquefied natural gas phase separator 30.

Particularly, the operating system of a liquefied natural gas ship for performing sub-cooled liquefaction of boil-off gas for re-liquefaction according to the first preferred embodiment of the present invention includes the parallel pipe having the same structure as the structure in which the check valve 50 and the pressure control valve 60 are installed in the pipe between the liquefied natural gas phase separator 30 and the check valve 50. The parallel pipe includes the check valve 50' for preventing reverse flow generated due to the abnormal pressure increase, and the pressure control valve 60' for maintaining the predetermined pressure of the liquefied natural gas phase separator 30 by adjusting the quantity of boil-off gas generated by the boil-off gas compressor 10 such that the liquefied natural gas phase separator 30, operated under the sub-cooling condition, is stably operated. The end of the parallel pipe is connected to a pipe between the boil-off gas compressor 10 and the cryogenic heat exchanger 20 such that boil-off gas, discharged from the boil-off gas compressor 10, is supplied to the upper vapor region of the liquefied natural gas phase separator 30 for the purpose of blanket during sub-cooling liquefying operation, so that pressure and level of liquefied natural gas of the liquefied natural gas phase separator 30 are stably controlled.

The operating system according to the first preferred embodiment of the present invention supplies boil-off gas discharged from the boil-off gas compressor 10 to the vapor region of the liquefied natural gas phase separator 30 for the purpose of blanket such that pressure and level of the liquefied natural gas of the liquefied natural gas phase separator 30 are stably controlled.

In the operating system according to the first preferred embodiment of the present invention, boil-off gas of about −100 degrees centigrade, 0.05 bar, g, 5,717 kg/hr, generated from every cargo tank, is changed into boil-off gas of about −120 degrees centigrade, 0.05 bar, g, 6,127 kg/hr, is supplied to the boil-off gas compressor 10, and is supplied to the cryogenic heat exchanger 20 after being compressed into boil-off gas of a predetermined temperature and a predetermined pressure, i.e. about −(below zero) 27 degrees centigrade, 3.49 bar, g.

The supplied boil-off gas, as described above, requires a specific quantity of refrigerant having a specific temperature for the sub-cooled liquefaction of boil-off gas. The cryogenic heat exchanger 20 performs heat exchange between boil-off gas compressed at the predetermined pressure by the refrigerator system 40, which serves as a refrigerator system for producing the required refrigerant and includes compressors, coolers, and a turbo-expander, and cold refrigerant generated from the refrigerator system 40 to liquefy boil-off gas, and supplies boil-off gas about −167 degrees centigrade, 3.19 bar, g, 6,127 kg/hr to the liquefied natural gas phase separator 30.

Meanwhile, the liquefied natural gas phase separator 30 is connected to the gas combustion unit 80 for oxidizing flash gas generated from the liquefied natural gas phase separator 30 to maintain the predetermined pressure of the liquefied natural gas phase separator 30 when flash gas is generated and pressure is increased due to the abnormal operation of the liquefied natural gas phase separator 30. When flash gas is generated and pressure is increased due to the abnormal operation of the liquefied natural gas phase separator 30, the liquefied natural gas phase separator 30 discharges flash gas, generated from the liquefied natural gas phase separator 30 to the gas combustion unit 80 via the check valve 50 for preventing reverse flow due to the abnormal pressure increase generated by flash gas and the pressure control valve 60, which are installed in the pipe connected to the gas combustion unit 80, so that the gas combustion unit 80 maintains the predetermined pressure of the liquefied natural gas phase separator 30 by oxidizing flash gas.

In addition to operations as described above, particularly, the operating system of a liquefied natural gas ship for performing sub-cooled liquefaction of boil-off gas for re-liquefaction according to the first preferred embodiment of the present invention includes the parallel pipe having the same structure as the structure in which the check valve 50 and the pressure control valve 60 are installed in the pipe between the liquefied natural gas phase separator 30 and the check valve 50. The parallel pipe includes the check valve 50' for preventing reverse flow generated due to the abnormal pressure increase, and the pressure control valve 60' for maintaining the predetermined pressure of the liquefied natural gas phase separator 30 by adjusting the quantity of boil-off gas generated by the boil-off gas compressor 10 such that the liquefied natural gas phase separator 30, operated under the sub-cooling condition, is stably operated. The end of the parallel pipe is connected to the pipe between the boil-off gas compressor 10 and the cryogenic heat exchanger 20 such that boil-off gas, discharged from the boil-off gas compressor 10, is supplied to the upper vapor region of the liquefied natural gas phase separator 30 for the purpose of blanket during sub-cooling liquefying operation. Thus, pressure and level of liquefied natural gas of the liquefied natural gas phase separator 30 are stably controlled.

Figure 2:
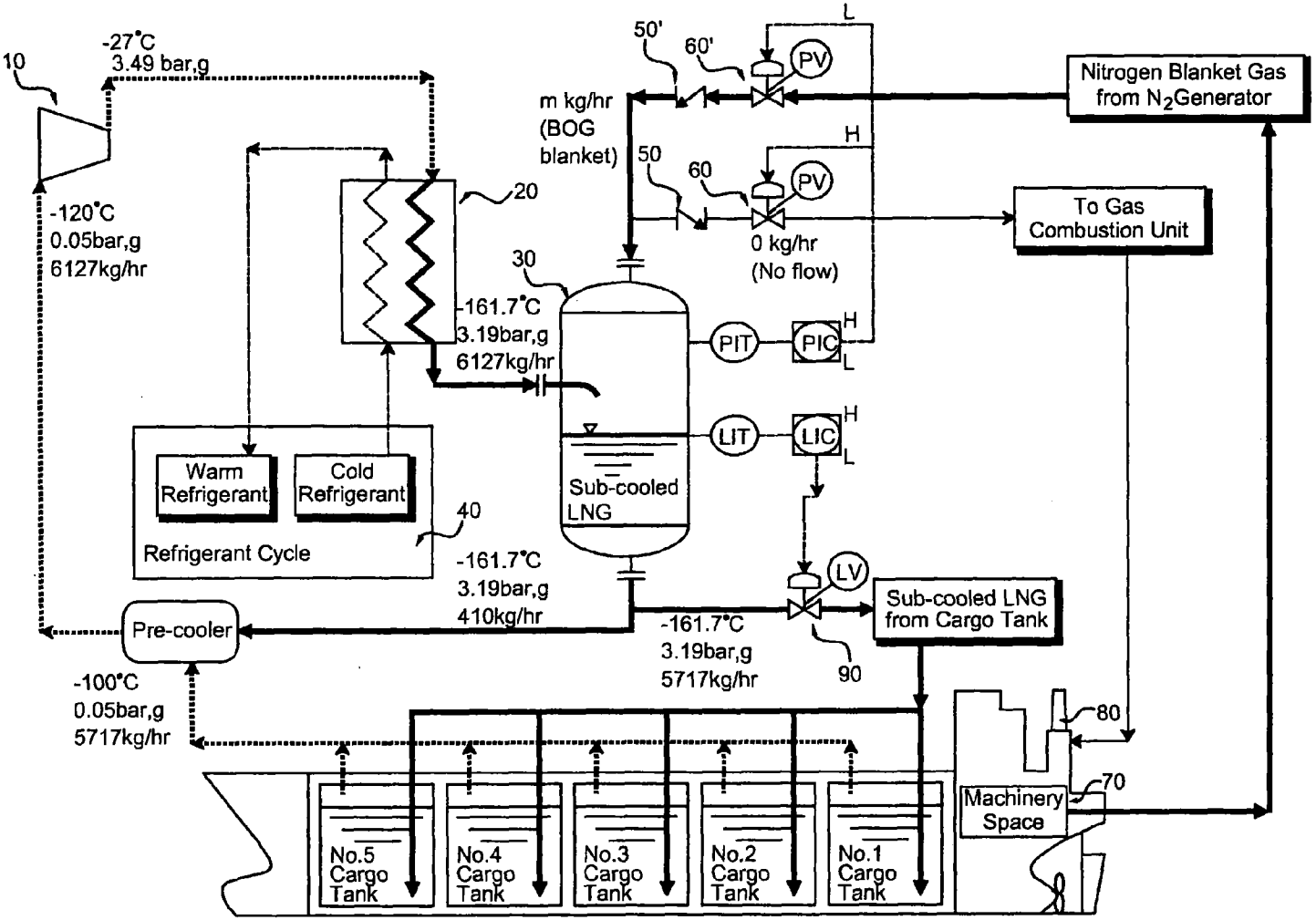
FIG. 2 is a schematic system diagram illustrating an operating system for performing sub-cooled liquefaction of boil-off gas in a liquefied natural gas ship according to another preferred embodiment of the present invention.

The operating system of a liquefied natural gas ship for performing sub-cooled liquefaction of boil-off gas for re-liquefaction according to the second preferred embodiment of the present invention will be described in detail with reference to FIG. 2 as follows.

The operating system of a liquefied natural gas ship according to the second preferred embodiment of the present invention includes most of elements of the operating system of a liquefied natural gas ship according to the first preferred embodiment of the present invention, and particularly, further includes a parallel pipe connected to a pipe for connecting the liquefied natural gas phase separator 30 with the check valve 50 in parallel and has the same structure as that of the pipe in which the check valve 50 and the pressure control valve 60 are installed. The parallel pipe is connected to a nitrogen generator 70 installed in the machinery space of the liquefied natural gas ship and serves to supply nitrogen gas to the liquefied natural gas phase separator 30, operated under the sub-cooling condition, for the purpose of maintaining a predetermined pressure of the liquefied natural gas phase separator 30. The parallel pipe includes the check valve 50' for preventing reverse flow generated when pressure of the pipe is abnormally increased and the pressure control valve 60' for maintaining the predetermined pressure of the liquefied natural gas phase separator 30 by adjusting the quantity of nitrogen gas for the purpose of stable operation of the liquefied natural gas phase separator 30 operated under the sub-cooling condition.

Operations of the operating system of a liquefied natural gas ship for performing sub-cooled liquefaction of boil-off gas for re-liquefaction according to the second preferred embodiment of the present invention are identical to those of the operating system according to the first preferred embodiment of the present invention. The operating system according to the second preferred embodiment of the present invention includes the parallel pipe connected to the pipe for connecting the liquefied natural gas phase separator 30 with the check valve 50 in parallel and has the same structure as that of the pipe in which the check valve 50 and the pressure control valve 60 are installed. The parallel pipe is connected to the nitrogen generator 70 installed in the machinery space of the liquefied natural gas ship and serves to supply nitrogen gas to the liquefied natural gas phase separator 30, operated under the sub-cooling condition, for the purpose of maintaining a predetermined pressure of the liquefied natural gas phase separator 30, and includes the check valve 50' for preventing reverse flow generated when pressure of the pipe is abnormally increased and a pressure control valve 60' for maintaining the predetermined pressure of the liquefied natural gas phase separator 30 by adjusting the quantity of nitrogen gas for the purpose of stable operation of the liquefied natural gas phase separator 30 operated under the sub-cooling condition. According to the operating system according to the second preferred embodiment of the present invention, power consumption caused by additional boil-off gas and pressure loss, generated due to excess generation of two-phase regions in a liquefied natural gas return line, is effectively reduced and economical efficiency is achieved due to simple operation. Moreover, due to the structure different from the structure of the operation system according to the first preferred embodiment of the present invention, nitrogen gas is supplied from the nitrogen generator 70 to the vapor region of the liquefied natural gas phase separator 30 for the purpose of blanket during the sub-cooled liquefaction, so that operating pressure and level of liquefied natural gas of the liquefied natural gas phase separator 30 are stably controlled.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

As described above, a system of re-liquefying boil-off gas in a liquefied natural gas ship is modified into an efficient sub-cooled liquefaction system so that power consumption caused by additional boil-off gas and pressure loss, generated due to excess generation of two-phase regions in a liquefied natural gas return line, is effectively reduced. Moreover, due to the structure different from the structure of the operation system according to the first preferred embodiment of the present invention, nitrogen gas is supplied from the nitrogen generator to the vapor region of the liquefied natural gas phase separator for the purpose of blanket during the sub-cooled liquefaction, so that operating pressure and level of liquefied natural gas of the liquefied natural gas phase separator are stably controlled, and economical efficiency is achieved due to simple operation.

What is claimed is:

1. A method for reliquefying boil-off gas generated in a cargo tank of a liquefied natural gas ship, the method comprising the steps of:

compressing boil-off gas generated in the cargo tank with a compressor to a pressure of about 3.49 bar, g and a temperature of about −27° C.;

sub-cooling the compressed boil-off gas in a heat exchanger to a temperature of about −161.7° C. to liquefy the compressed boil-off gas;

feeding the liquefied gas to a gas phase separator;

monitoring a gas pressure within the gas phase separator with a first pressure control valve;

venting flash gas generated in the gas phase separator through a first pipe connected to the gas phase separator, the flash gas being vented by the first pressure control valve upon detecting an increase in the gas pressure in the gas phase separator by the first pressure control valve, the first pipe having a first check valve and the first pressure control valve installed therein, the first check valve preventing reverse flow into the gas phase separator upon a decrease in the gas pressure within the gas phase separator;

feeding the vented flash gas from the gas phase separator to a gas combustion unit of the ship via the first pipe;

oxidizing the vented flash gas in the gas combustion unit;

monitoring the gas pressure within the gas phase separator with a second pressure control valve;

diverting a portion of the compressed boil-off gas from the compressor through a second pipe connected between the compressor and the gas phase separator, the quantity of the portion of the compressed boil-off gas diverted from the compressor being adjusted by the second pressure control valve upon detecting a decrease in the gas pressure in the gas phase separator by the second pressure control valve, the second pipe being parallel to the first pipe, the second pipe having a second check valve and the second pressure control valve installed therein, the second check valve preventing reverse flow out of the gas phase separator upon an increase in the gas pressure within the gas phase separator;

feeding the diverted portion of compressed boil-off gas from the compressor to an upper region of the gas-phase separator for blanketing the gas-phase separator such that the gas pressure and level of liquefied gas in the gas-phase separator are stably controlled; and returning liquefied gas from the gas-phase separator to the cargo tank.

2. The method as defined in claim 1, further comprising the step of pre-cooling the boil-off gas generated in the cargo tank to a temperature of about −120° C. prior to compressing the boil-off gas in the compressor.

* * * * *

UNITED STATES PATENT AND TRADEMARK OFFICE

CERTIFICATE OF CORRECTION

PATENT NO. : 8,256,230 B2
APPLICATION NO. : 12/688411
DATED : September 4, 2012
INVENTOR(S) : An et al.

It is certified that error appears in the above-identified patent and that said Letters Patent is hereby corrected as shown below:

In the Specification:

Column 1, line 11:

Now reads: "filed Jul. 17, 2005, which"

Should read: -- filed July 19, 2005, which --

Signed and Sealed this
Twenty-third Day of July, 2013

Teresa Stanek Rea
*Acting Director of the United States Patent and Trademark Office*